US007052172B2

(12) United States Patent
Jahn et al.

(10) Patent No.: US 7,052,172 B2
(45) Date of Patent: May 30, 2006

(54) COMBINATION LOW-SHEAR MIXER AND HIGH-SHEAR HOMOGENIZER

(75) Inventors: Karl Jahn, Roswell, GA (US); Trevor Williams, Kennesaw, GA (US)

(73) Assignee: Omni International, Inc., Marietta, GA (US)

( * ) Notice: Subject to any disclaimer, the term of this patent is extended or adjusted under 35 U.S.C. 154(b) by 257 days.

(21) Appl. No.: 10/662,721

(22) Filed: Sep. 15, 2003

(65) Prior Publication Data

US 2005/0058019 A1 Mar. 17, 2005

(51) Int. Cl.
*B01F 7/18* (2006.01)

(52) U.S. Cl. ..... 366/293; 366/296

(58) Field of Classification Search ..... 366/293, 366/294, 295, 296, 262, 263, 264, 265
See application file for complete search history.

(56) References Cited

U.S. PATENT DOCUMENTS

| | | | | | |
|---|---|---|---|---|---|
| 859,943 | A | | 7/1907 | Holden | |
| 1,253,394 | A | * | 1/1918 | Lambie | 366/296 |
| 1,392,789 | A | * | 10/1921 | Paris | 366/296 |
| 1,428,438 | A | * | 9/1922 | Kelly | 366/246 |
| 1,945,212 | A | | 1/1934 | Akers | |
| 2,209,287 | A | * | 7/1940 | Simpson | 366/296 |
| 2,668,694 | A | * | 2/1954 | Monick et al. | 366/294 |
| 2,789,800 | A | | 4/1957 | Willems | |
| 2,985,389 | A | | 5/1961 | Willems | |
| 3,251,580 | A | | 5/1966 | Adams | |
| 3,299,924 | A | | 1/1967 | Hanschitz | |
| 3,333,830 | A | | 8/1967 | Spingler et al. | |
| 3,334,869 | A | * | 8/1967 | Takashi | 366/294 |
| 3,578,876 | A | * | 5/1971 | Stratienko | 366/293 |
| 3,724,765 | A | | 4/1973 | Rohrbaugh et al. | |
| 3,912,236 | A | | 10/1975 | Zipperer et al. | |
| 4,307,846 | A | | 12/1981 | Spelsberg | |
| 4,405,998 | A | | 9/1983 | Brison | |
| 4,530,606 | A | | 7/1985 | Hopkins et al. | |
| 4,850,699 | A | | 7/1989 | Rebordosa | |
| 5,316,382 | A | | 5/1994 | Penaranda et al. | |
| 6,250,846 | B1 | * | 6/2001 | Kawabata et al. | 366/293 |
| 6,491,422 | B1 | | 12/2002 | Rutten et al. | |

* cited by examiner

*Primary Examiner*—Tony G. Soohoo
(74) *Attorney, Agent, or Firm*—Gardner Groff Santos & Greenwald, PC

(57) ABSTRACT

A combination fin-type mixer and rotor/stator-type homogenizer provides the ability to perform low-shear mixing or high-shear homogenizing by a single device without changing attachments or hardware. The low-shear mixing fins extend outwardly from the stator of the high-shear rotor/stator homogenizer, and the rotor rotates within the stator. For high-shear homogenizing, the rotor is rotated within the stator. And for low-shear mixing, the finned stator is selectively interlocked to and rotated with the rotor. A method of combining components includes resetting the device from low-shear mixing mode to high-shear homogenizing mode, and vice versa, without changing attachments or hardware.

24 Claims, 4 Drawing Sheets

COMBINATION LOW-SHEAR MIXER AND HIGH-SHEAR HOMOGENIZER

TECHNICAL FIELD

The present invention relates to physical processes for combining components in the chemistry field and, more particularly, to laboratory mixing and homogenizing processes for combining fluids, semi-fluids, and/or solids.

BACKGROUND OF THE INVENTION

There are two distinct types of methods commonly used for joining compounds. One type, commonly referred to as mixing, involves agitating or stirring the components utilizing a low-shear process with no significant micron-level particle size reduction in the joined components. Mixing is often used for combining two soluble fluids, dissolving solids into fluids before the supersaturation point, and similar activities. The other type, commonly referred to as homogenizing, involves disaggregating or emulsifying the components utilizing a high-shear process with significant micron-level particle size reduction of the joined components. Homogenizing is often used for creating emulsions, reducing agglomerate particles to increase reaction area, cell destruction for capture of DNA material, and similar activities.

These two types of methods are radically different in their execution and results. Low-shear mixers typically have rotary or vibratory paddles or fins, while many high-shear homogenizers have a rotor and stator construction. (There are other types of homogenizers, including pressure-based homogenizers, mill homogenizers, ultrasonic homogenizers, and other types of mechanical shear homogenizers, however, rotor-stator-type mechanical shear homogenizers are the most common in the present field.) Low-shear mixers are insufficient for experiments requiring particle size reduction, and high-shear homogenizers are too harmful to the sample for experiments requiring only low-shear mixing.

Because of these significant differences, differently constructed and separate devices are used for each of these two processes. As a result, laboratories commonly have both a low-shear mixer and a high-shear homogenizer. This adds to laboratory set-up and maintenance costs, and reduces available laboratory bench space.

Accordingly, there is a need for a way to more efficiently accomplish low-shear mixing and high-shear homogenizing in a laboratory. It is to the provision of a device meeting this and other needs that the present invention is primarily directed.

SUMMARY OF THE INVENTION

Generally described, the present invention comprises a device for combining components in at least two different modes of operation. The device includes a hollow member and a rotor that rotates within the hollow member in a first combining mode, a plurality of fins extending outwardly from the hollow member, wherein the hollow member rotates in a second combining mode, an actuator operably coupled to the rotor, and an interlock assembly adapted to permit selectively operating the device in the first combining mode or the second combining mode. Preferably, the interlock assembly is adapted to permit the rotor to rotate independent of the hollow member and to restrict rotation of the hollow member in the first combining mode, and to interlock the hollow member and the rotor so that the hollow member rotates with the rotor in the second combining mode.

In a first exemplary embodiment of the invention, the rotor and the hollow member are configured to perform high-shear homogenizing in the first combining mode to and to perform low-shear mixing in the second combining mode. For example, the rotor may have one or more blades that rotate within the hollow member, and the hollow member may have a plurality of windows in alignment with the blades and interposed between the fins. It will be understood that these elements can be otherwise configured for producing other methods of combining components.

The interlock assembly of the first exemplary embodiment comprises a first one-way bearing mounted to the rotor and the hollow member, wherein the first one-way bearing is adapted to permit the rotor to rotate in a first direction independent of the hollow member in the first combining mode and to interlock the hollow member and the rotor so that the hollow member rotates with the rotor in a second opposite direction in the second combining mode. In addition, the interlock assembly comprises a second one-way bearing mounted to the hollow member and the external housing, wherein the second one-way bearing is adapted to restrict rotation of the hollow member when the rotor is rotated in the first direction in the first combining mode and to permit the interlocked hollow member and rotor to rotate in the second opposite direction independent of the external housing. Also, the actuator comprises a reversible motor that is operable in the first direction or the second opposite direction for operating the device in the first combining mode or the second combining mode.

It will be understood that the interlock assembly may comprise other structures that permit selectively operating the device in the first combining mode or the second combining mode. For example, the interlock assembly may comprise a ratchet mechanism, a gear-set, a retainer that is manually moved into locking engagement with the hollow member and the rotor, another mechanical locking member, or a combination of these.

In a second exemplary embodiment, the fins are angled to induce radial and axial flow of the components in the second combining mode. And in a third exemplary embodiment, the device includes a collar that is removably mounted to the hollow member and that has the fins mounted thereto.

In another aspect of the invention, there is provided a method of combining components. The method includes the steps of providing a device for combining components, operating the device in a first combining mode, resetting the device for operation in a second combining mode without adding, removing, or changing any elements of the device, and operating the device in the second combining mode. Preferably, the device comprises a hollow member with a plurality of outwardly extending fins and a rotor having at least one blade, and wherein the step of operating the device in the first combining mode comprises rotating the rotor blade within the hollow member, and the step of operating the device in the second combining mode comprises interlocking the hollow member and the rotor and rotating the rotor. The step of operating the device in the first combining mode preferably comprises performing high-shear homogenizing of the components, and the step of operating the device in the second combining mode preferably comprises performing low-shear mixing of the components.

Accordingly, the present invention combines both low-shear mixing and high-shear homogenizing in a single device. The device can be operated in a high-shear mode for radical micron-level particle size reduction, and can then be operated in a low-shear mode without threatening the sample with the aggressive and damaging effects of high-shear homogenizing, without having to change, remove, or add any hardware. This dual-purpose device reduces laboratory inventory, clears valuable laboratory bench space, and increases affordability of doing experiments that require both low- and high-shear processing.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

Figure 1:
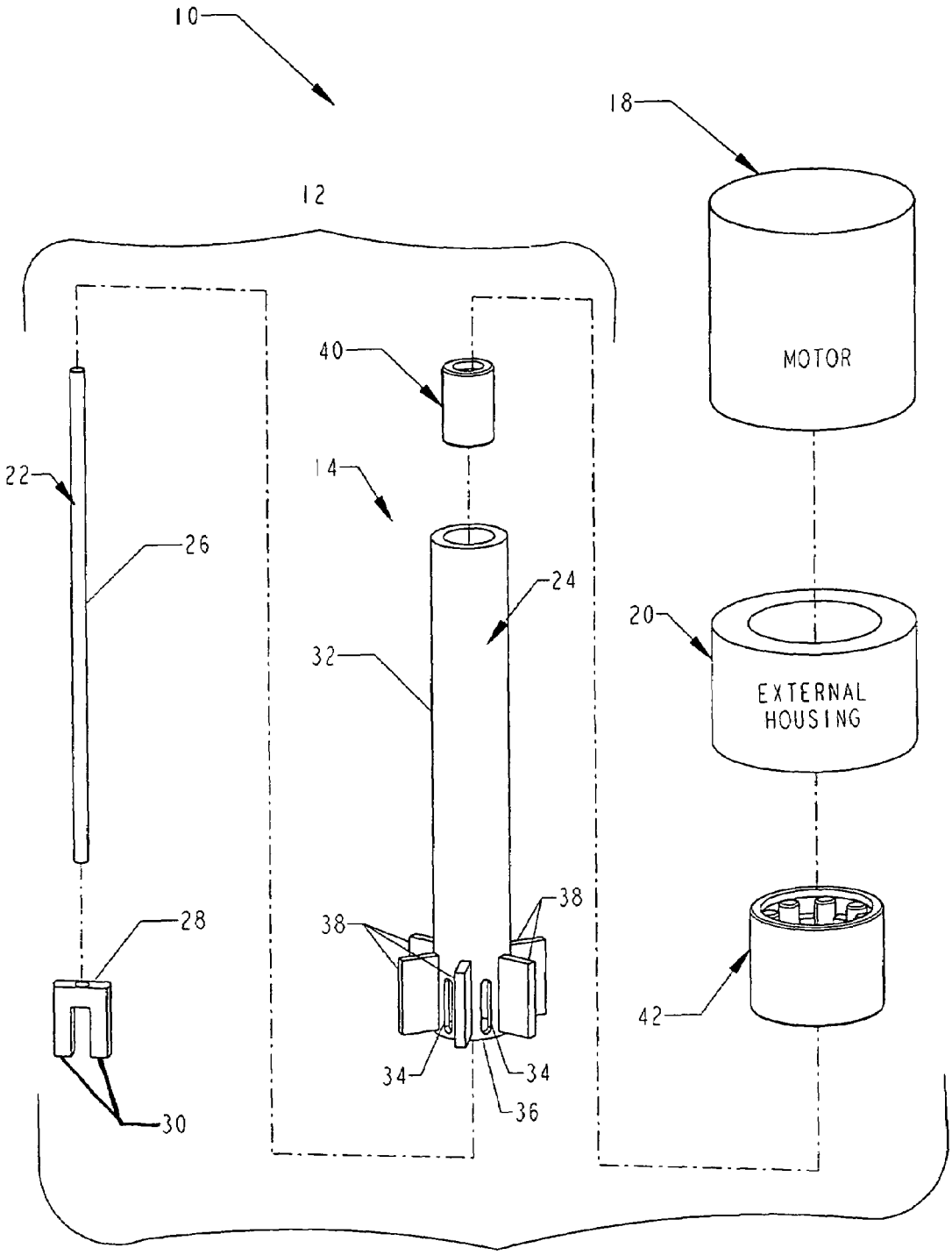
FIG. 1 is an exploded perspective view of a combination mixer/homogenizer device according to a first exemplary embodiment of the invention, showing a rotor and stator for homogenizing, fins on the stator for mixing, and a selective interlock assembly for permitting homogenizing and mixing.
Figure 2:
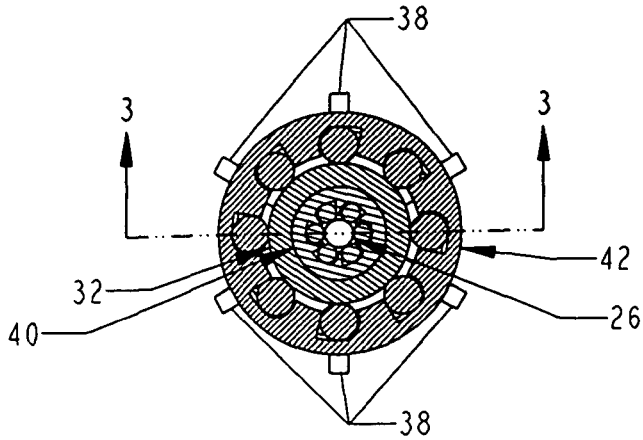
FIG. 2 is a cross-sectional view of the mixer/homogenizer device of FIG. 1 taken at line 2—2 of FIG. 3.
Figure 3:
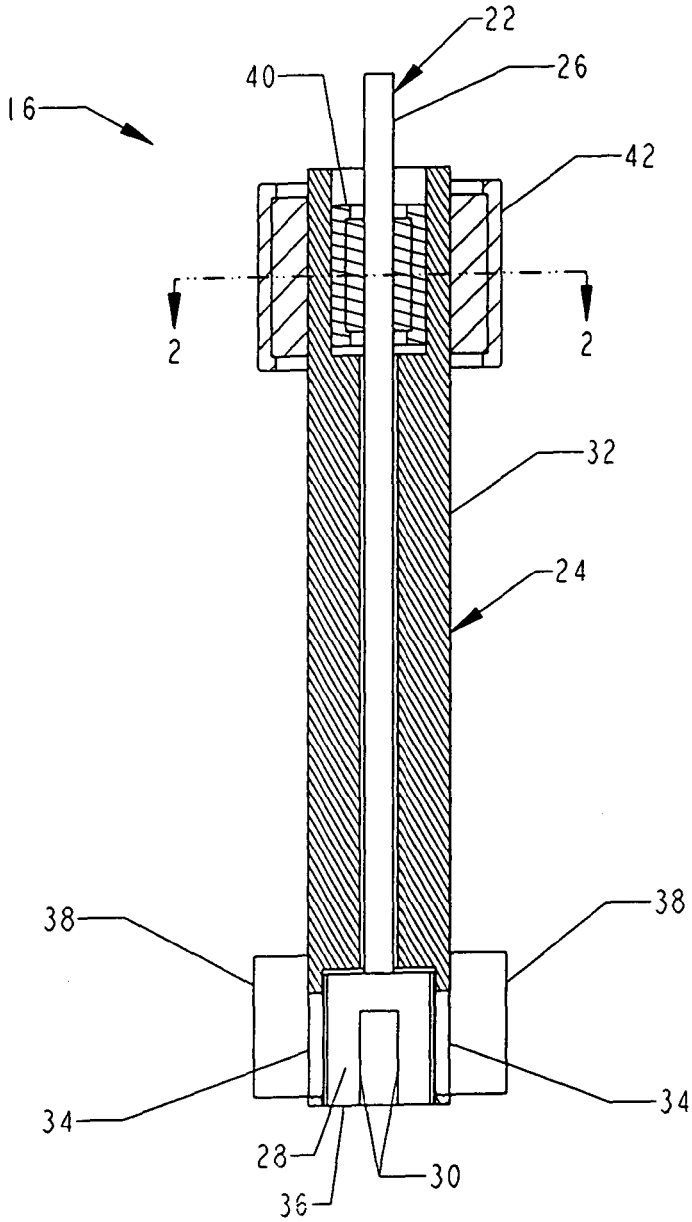
FIG. 3 is a cross-sectional view of the mixer/homogenizer device of FIG. 1 taken at line 3—3 of FIG. 2.
Figure 4:
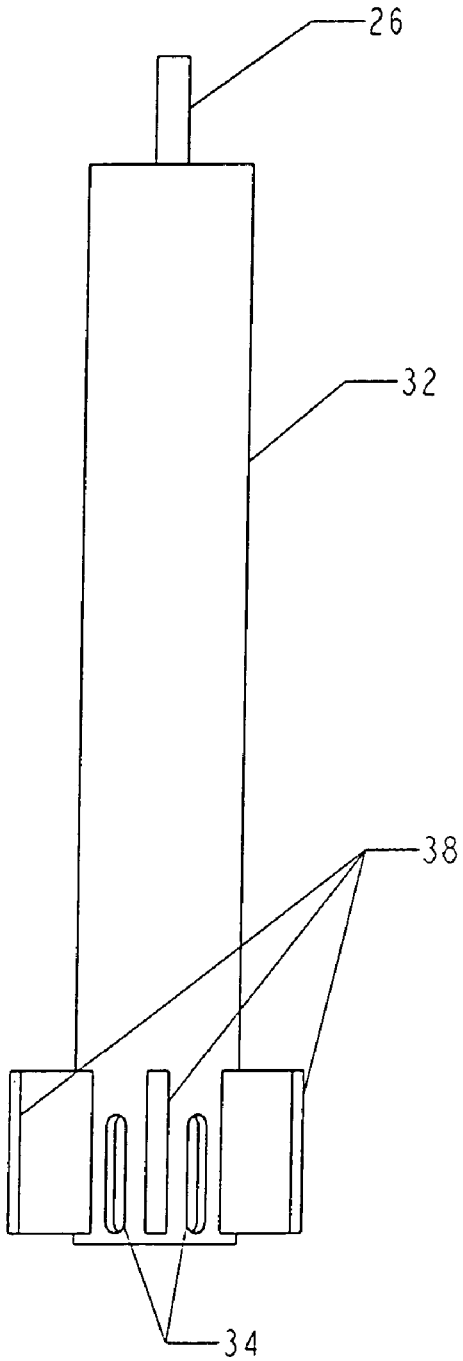
FIG. 4 is an elevation view of the finned stator of the mixer/homogenizer device of FIG. 1.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

As used herein, the term "mixing" means agitating or stirring the components using a low-shear process causing no significant micron-level particle size reduction in the joined components. In addition, the term "homogenizing" means disaggregating or emulsifying the components using a high-shear process causing significant micron-level particle size reduction of the joined components. And the term "combining" means mixing, homogenizing, or otherwise joining two components together.

Referring to FIGS. 1–4, there is illustrated a combination low-shear mixer and high-shear homogenizer device according to a first exemplary embodiment of the present invention, generally referred to as the mixer/homogenizer or the device 10. The device 10 is typically used for mixing and/or homogenizing two or more components such as fluids, semi-fluids (fluids and suspended particles), and/or solids, in volumes ranging from 5 gallons to 1 microliter. It will be understood that the device 10 can be adapted for otherwise combining components in other volumes.

The device 10 includes a homogenizing assembly 12, a mixing assembly 14, a selective interlock assembly 16, and an actuator 18. The actuator 18 is typically provided by an electric motor, but alternatively it can be provided by a pneumatic or hydraulic device or by another type of actuator that produces rotational motion. Preferably, one actuator 18 drives both the homogenizing assembly 12 and the mixing assembly 14, but multiple dedicated actuators can be provided if desired.

In addition, the device 10 typically includes an external housing 20 of the type that is commonly used in laboratory devices for combining components. For example, the external housing 20 may have an upper portion and a base portion. The upper portion is sized and shaped for housing the actuator 18 and mounting the operator controls (on/off, rotor speed, timer, etc.). And the base portion is sized and shaped for standing the device upright and/or detachably coupling it to a fluid container. In an alternative embodiment, the external housing is sized and shaped for using the device as a hand tool. In any event, the external housing 20 can be secured to the actuator, it can enclose the actuator, and/or it can be integral to the actuator's housing. For simplicity, the specific size and shape of the external housing 20 is not shown in the drawing figures.

The homogenizing assembly 12 is of a conventional type and includes a rotor 22 and a stator 24. The rotor 22 has a drive shaft 26 and a knife 28 with one or more blades 30. The stator 24 has a hollow member 32 with an open bottom 36 and with windows 34 that are aligned with the blades 30.

In the homogenizing mode of operation, the actuator 18 drives the rotor 22 to rotate the rotor blades 30 at a relatively high speed in the stator hollow member 32, which is preferably locked in a stationary position by the interlock assembly 16. The rotary action of the blades 30 within the stator hollow member 32 draws the fluid or other components into the hollow member 32 through the open bottom 36 and forces them out of the hollow member 32 through the windows 34, in the process homogenizing them. In this mode of operation, the device 10 functions as a conventional rotor-stator homogenizing device.

It will be understood that the homogenizing assembly 12 may be provided with other rotor-stator configurations. For example, in alternative embodiments the homogenizing assembly 12 has blades extending inwardly from the inside wall of the hollow member, blades that extend the entire length of the hollow member and/or out of the open end of the hollow member, blades with angles for inducing radial and axial fluid movement, a stator with an open top and without the windows, and/or a hollow member that is not locked in a stationary position. And in another embodiment, the homogenizing assembly 12 includes the rotor with blades and the stator with fins, without the interlock assembly, for operating in only the high-shear mode to produce improved homogenization.

The mixing assembly 14 includes a plurality of fins 38 extending radially outwardly from the hollow member 32. The number, shape, size, and position of the fins 38 are selected to provide the mixing properties desired. Preferably, the fins 38 are interposed between the windows 34 of the hollow member 32. The fins 38 are of a conventional type typically provided in fin-type mixers. For example, the fins 38 may be provided by paddles, blades, or any other vane-like structures that induce movement of a fluid.

In the mixing mode of operation, the actuator 18 drives the rotor 22, which is locked to the hollow member 32 by the selective interlock assembly 16. In this way, the hollow member 32 rotates along with the rotor 22 at a relatively slow speed. The rotary action of the fins 38 on the stator hollow member 32 creates turbulence and thereby mixes the fluid or other components. In addition, the rotor knife 28 is locked to the stator hollow member 32 by the interlock assembly 16, so no mechanical shearing occurs between the two parts.

It will be understood that the mixing assembly 14 may be provided with other configurations of fins. For example, in alternative embodiments the mixing assembly 14 has fins with variations in size and/or shape, fins arranged in a staggered configuration on the hollow member, fins that extend the entire length of the hollow member, and/or a different number of fins positioned elsewhere on the hollow member.

In addition, the fins 38 added to the stator 24 for mixing also improve homogenizing performance. While in the homogenizing mode, the fins 38 on the exterior of the stator hollow member 32 induce axial fluid movement for better circulation and reduce vortexing of the fluid. The reduction in vortexing is beneficial because it is common for rotor-stators to vortex the fluid, pulling the fluid surface all the way to the rotor stator-interface; this then homogenizes air into the fluid and suspends or emulsifies the air into the sample. For a sample sensitive to extreme vortexing, the fins 38 could prevent a complete loss of the sample. Also, when air is homogenized into the fluid, it reduces the pump efficiency of the homogenizer (the device works basically as a centrifugal pump). Therefore, the reduction in fluid density causes a reduction in pump force.

Turning now to the selective interlock assembly 16, it can be provided by commercially available components selected and mounted to permit selectively operating the device 10 in the first combining mode or the second combining mode. Preferably, the interlock assembly 16 permits the rotor 22 to rotate independently of the hollow member 32 and restricts rotation of the hollow member in the homogenizing mode, and interlocks the hollow member and the rotor so that the hollow member rotates with the rotor in the mixing mode.

As an example, the interlock assembly may include conventional one-way bearings that function as simple bearings permitting unrestrained rotary movement in one direction, but that lock and do not allow rotary movement in the opposite direction. A first one-way bearing 40 is mounted to the rotor 22 and the stator hollow member 32, and a second one-way bearing 42 is mounted to the hollow member 32 and the external housing 20, with the bearings 40 and 42 mounted to permit rotary movement in opposite directions. That is, the first one-way bearing 40 is selected and mounted to permit the rotor 22 to rotate in a first direction independent of the hollow member 32 in the homogenizing mode and to interlock the hollow member and the rotor so that the hollow member rotates with the rotor in a second opposite direction in the mixing mode. And the second one-way bearing 42 is selected and mounted to restrict rotation of the hollow member 32 when the rotor 22 is rotated in the first direction in the homogenizing mode and to permit the interlocked hollow member and rotor to rotate in the second opposite direction independent of the external housing. Where the first and second one-way bearings 40 and 42 are provided by needle-type bearings, additional bearings such as a radial ball bearings (not shown), may be provided to maintain the position of the one-way bearings relative to the rotor 22, the hollow member 32, and the external housing 20. In addition, the actuator 18 is provided by a reversible motor that can be readily operated in the first direction or the second direction to operate the device 10 for homogenizing or mixing.

In the homogenizing mode, the rotor drive shaft 26 is rotated by the actuator 18 in the first direction, for example, clockwise. The first bearing 40 pressed into the stator hollow member 32 allows clockwise rotation so the drive shaft 26 turns freely inside the stator hollow member 32, thereby driving the rotor blades 30 within the stator windows 34. Various forces try to turn the stator hollow member 32 in the clockwise direction (in reaction to the spinning rotor 22), but the second bearing 42 pressed into the exterior housing 20 does not allow clockwise rotation and binds the stator hollow member 32 to the exterior housing 20, counteracting these forces to keep the stator from spinning.

In the mixing mode, the rotor drive shaft 26 is rotated by the actuator 18 in the second direction, for example, counterclockwise. So the user resets the device 10 for the mixing mode by changing the direction controller of the actuator 18. The first bearing 40 pressed into the stator hollow member 32 does not allow counterclockwise movement and therefore locks the rotor drive shaft 26 to the hollow member. The rotor 22 and hollow member 32 now turn as one in the counterclockwise direction. The second bearing 42 pressed into the exterior housing 20 allows counterclockwise rotation, thereby functioning as a normal bearing.

It will be understood that the interlock assembly may comprise other structures that permit selectively operating the device in the homogenizing mode or the mixing mode. For example, in alternative embodiments the interlock assembly includes ratchet mechanisms, gear-sets, and/or other mechanisms for permitting one-way rotation. And in other alternative embodiments, the interlock assembly includes a retainer that is manually moved into locking engagement with the hollow member and the rotor, a solenoid or other plunger that is selectively extended into a receptacle to prevent movement between the hollow member and the rotor, and/or another mechanical locking member that can be moved between an unlocked position for operation in the homogenizing mode and a locked position for operation in the mixing mode. With these interlock assemblies, the actuator can be provided by a one-direction rotary motor. In addition, the device may be provided with controls for manipulating these interlock assemblies to reset them between positions for operation in the homogenizing mode and the mixing mode. Accordingly, the herein described interlock assemblies are provided merely as representative structures, and the present invention is not intended to be limited to any particular type of interlock assembly, except as specifically defined in the claims.

Figure 5:
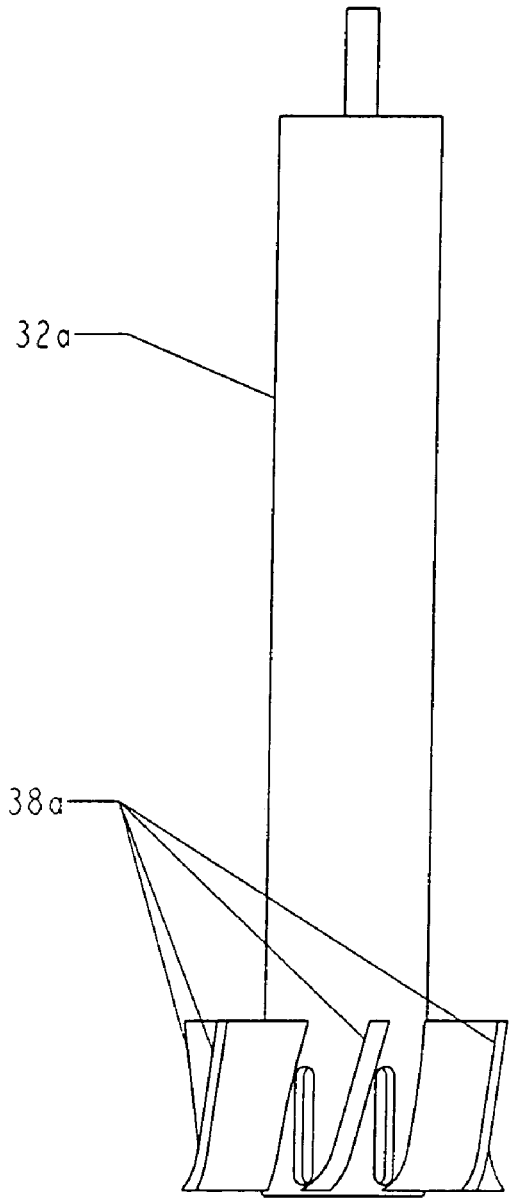
FIG. 5 is an elevation view of a finned stator of a mixer/homogenizer device according to a second exemplary embodiment of the present invention, showing the mixing fins oriented at an angle to the stator axis.

Referring to FIG. 5, a device according to a second exemplary embodiment of the present invention includes a hollow member 32*a* with fins 38*a* that are angled. The angle of the fins 38*a* is selected to induce radial and axial flow of the fluid or other components relative to the stator hollow member 32*a*. Accordingly, the angled fins 38*a* may be generally flat or curved, with a profile and axial location selected to promote enhanced mixing of the fluid or other components.

Figure 6:
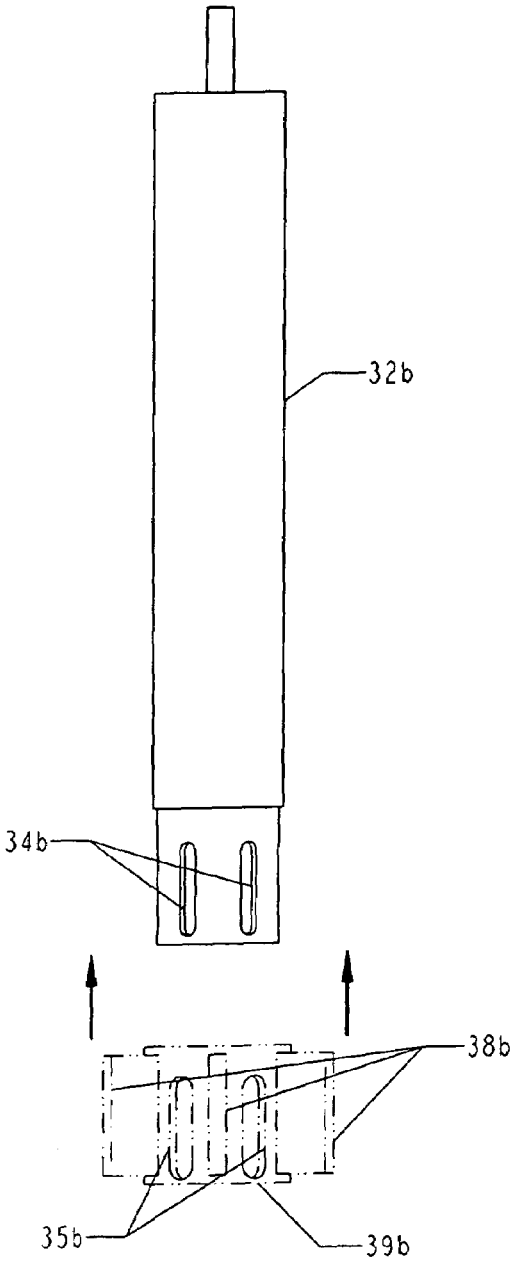
FIG. 6 is an elevation view of a finned stator of a mixer/homogenizer device according to a third exemplary embodiment, showing a detachable mixing fin assembly.
Figure 7:
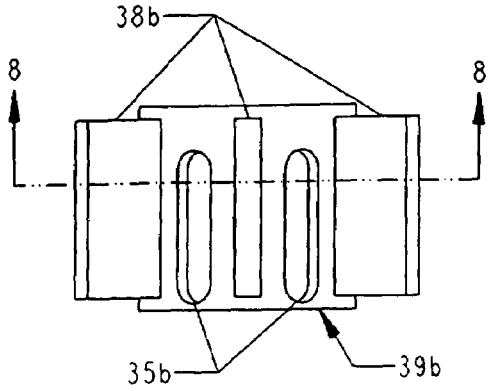
FIG. 7 is an elevation view of the detachable mixing fin assembly of FIG. 6.
Figure 8:
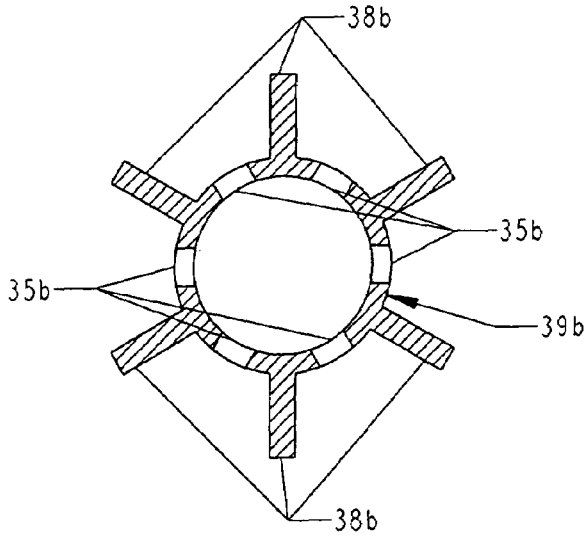
FIG. 8 is a cross-sectional view of the detachable mixing fin assembly of FIG. 7 taken at line 8—8.

Referring to FIG. 6, a device according to a third exemplary embodiment of the present invention includes a collar 39*b* that is removably mounted to the hollow member 32*b* and that has the fins 38*b* mounted to it. The collar 39*b* can be attached by screws, bolts, mating threaded elements, twist-lock mechanisms, or other fasteners. Preferably, the collar 39*b* has windows 35*b* that align with the windows 34*b* on the hollow member 32*b*. With this embodiment, the fins 38*b* can be selected for the low-shear mixing characteristics desired for a particular mixing job. So the one device can be used to accomplish a wide range of mixing tasks. But, of course, the fins 38*b* do not need to be removed for high-shear homogenizing.

In addition, a method of combining components is provided according to another aspect of the invention. The method includes the steps of providing a device for combining components, operating the device in a first combining mode, resetting the device for operation in a second combining mode without adding, removing, or changing any elements of the device, and operating the device in the second combining mode. Preferably, the device comprises a hollow member with a plurality of outwardly extending fins and a rotor having at least one blade, the step of operating the device in the first combining mode comprises rotating the rotor blade within the hollow member, and the step of operating the device in the second combining mode comprises interlocking the hollow member and the rotor and rotating the rotor. In this way, high-shear homogenizing and low-shear mixing can be achieved by a single device without changing attachments or hardware.

Accordingly, the present invention provides a number of advantages over the individual low-shear mixers and high-shear homogenizers of the prior art. In particular, the present invention combines both low-shear fin-type mixing structures and high-shear rotor-stator homogenizing structures into a single device. The device can be operated in a high-shear mode for radical micron-level particle size reduction, and can then be operated in a low-shear mode without threatening the sample with the aggressive and damaging effects of high-shear homogenizing, without manipulating or exchanging attachments or additional hardware. In this way, the combination mixing and homogenizing device reduces laboratory inventory, clears valuable laboratory bench space, and increases affordability of doing experiments that require both low- and high-shear processing.

In addition, to do a process which requires both homogenizing and mixing with currently available devices, you have to remove one device from the vessel and install the other. This could contaminate the specimen, lose some of the specimen, or spill the specimen (possibly dangerous to the user). Moreover, depending on which of the currently available mixing and homogenizing devices is used, the operator might have to change vessels to use the two devices (e.g., transfer to a blender or stirrer and back). The present invention saves on lost sample between vessels and saves time for the steps and subsequent cleaning.

While the invention has been described with reference to preferred and example embodiments, it will be understood by those skilled in the art that a variety of modifications, additions and deletions are within the scope of the invention, as defined by the following claims.

What is claimed is:

1. A device for combining components, comprising:

a) a hollow member and a rotor that includes one or more blades positioned at least partially within the hollow member, wherein the rotor blades are rotationally driven and the hollow member is not rotationally driven in a first combining mode; and b) a plurality of fins extending outwardly from the hollow member, wherein the hollow member is rotationally driven in a second combining mode.

2. The device of claim 1, further comprising an interlock assembly adapted to permit selectively operating the device in the first combining mode or the second combining mode.

3. The device of claim 2, wherein the interlock assembly is adapted to permit the rotor to rotate independent of the hollow member in the first combining mode and to interlock the hollow member and the rotor so that the hollow member rotates with the rotor in the second combining mode.

4. The device of claim 3, wherein the interlock assembly is adapted to restrict rotation of the hollow member in the first combining mode.

5. The device of claim 2, wherein the interlock assembly comprises a first one-way bearing mounted to the rotor and the hollow member, wherein the first one-way bearing is adapted to permit rotation in a first rotary direction but not in a second opposite rotary direction.

6. The device of claim 1, wherein the fins are angled to induce radial and axial flow of the components in the second combining mode.

7. The device of claim 1, further comprising a collar that is removably mounted to the hollow member and that has the fins mounted thereto.

8. The device of claim 1, further comprising an actuator operably coupled to the rotor.

9. The device of claim 1, wherein the rotor and the hollow member are configured perform high-shear homogenizing in the first combining mode to and to perform low-shear mixing in the second combining mode.

10. The device of claim 1, wherein the rotor blades are radially inside the hollow member, and the fins are radially outside the hollow member, and the blades and the fins are laterally aligned and positioned adjacent the bottom end of the hollow member.

11. The device of claim 1, wherein in the first combining mode, the rotor blades are rotationally driven but the hollow member is not, without decoupling the rotor or the hollow member from the device.

12. The device of claim 1, wherein in the second combining mode, the hollow member and the rotor blades are rotationally driven together.

13. A device for combining components, comprising:

a) a hollow member and a rotor at least partially within the hollow member, wherein the rotor rotates in a first combining mode;

b) a plurality of fins extending outwardly from the hollow member, wherein the hollow member rotates in a second combining mode; and c) an interlock assembly adapted to permit selectively operating the device in the first combining mode or the second combining mode, wherein the interlock assembly comprises a first one-way bearing mounted to the rotor and the hollow member, and wherein the first one-way bearing is adapted to permit the rotor to rotate in a first direction independent of the hollow member in the first combining mode and to interlock the hollow member and the rotor so that the hollow member rotates with the rotor in a second opposite direction in the second combining mode.

14. The device of claim 13, further comprising an external housing and an actuator, wherein the interlock assembly comprises a second one-way bearing mounted to the hollow member and the external housing or the actuator.

15. The device of claim 14, wherein the second one-way bearing is adapted to restrict rotation of the hollow member when the rotor is rotated in the first direction in the first combining mode and to permit the interlocked hollow member and rotor to rotate in the second opposite direction independent of the external housing.

16. A device for combining components, comprising:

a) a hollow member and a rotor at least partially within the hollow member, wherein the rotor rotates in a first combining mode;

b) a plurality of fins extending outwardly from the hollow member, wherein the hollow member rotates in a second combining mode, and wherein the rotor has one or more blades and the hollow member has a plurality of windows defined therein in alignment with the rotor blades.

17. The device of claim 16, wherein the windows are interposed between the fins.

18. A device for combining components, comprising:

a) a hollow member and a rotor having one or more blades that rotate at least partially within the hollow member in a first combining mode to perform high-shear homogenizing;

b) a plurality of fins extending outwardly from the hollow member, wherein the hollow member rotates in a second combining mode to perform low-shear mixing;

c) an actuator operably coupled to the rotor; and d) an interlock assembly adapted to permit selectively operating the device in the first combining mode or the second combining mode, wherein the interlock assembly is adapted to permit the rotor to rotate independent of the hollow member and to restrict rotation of the hollow member in the first combining mode, and to interlock the hollow member and the rotor so that the hollow member rotates with the rotor in the second combining mode.

19. The device of claim 18, wherein the interlock assembly comprises a first one-way bearing mounted to the rotor and the hollow member, wherein the first one-way bearing is adapted to permit the rotor to rotate in a first direction independent of the hollow member in the first combining mode and to interlock the hollow member and the rotor so that the hollow member rotates with the rotor in a second opposite direction in the second combining mode.

20. The device of claim 19, further comprising an external housing for the actuator, wherein the interlock assembly comprises a second one-way bearing mounted to the hollow member and the external housing or the actuator, wherein the second one-way bearing is adapted to restrict rotation of the hollow member when the rotor is rotated in the first direction in the first combining mode and to permit the interlocked hollow member and rotor to rotate in the second opposite direction independent of the external housing.

21. The device of claim 20, wherein the actuator comprises a reversible motor that is operable in the first direction or the second opposite direction for operating the device in the first combining mode or the second combining mode.

22. The device of claim 18, wherein the hollow member has a plurality of windows defined therein in alignment with the rotor blades and interposed between the fins.

23. The device of claim 18, wherein the fins are angled to induce radial and axial flow of the components in the second combining mode.

24. The device of claim 18, further comprising a collar that is removably mounted to the hollow member and that has the fins mounted thereto.

* * * * *